United States Patent [19]

Dambach

[11] Patent Number: 4,560,222

[45] Date of Patent: Dec. 24, 1985

[54] DRAWER CONNECTOR

[75] Inventor: Philip J. Dambach, Naperville, Ill.

[73] Assignee: Molex Incorporated, Lisle, Ill.

[21] Appl. No.: 611,441

[22] Filed: May 17, 1984

[51] Int. Cl.[4] ..... H01R 13/62

[52] U.S. Cl. ..... 339/75 MP; 339/75 M

[58] Field of Search ..... 339/74 R, 75 M, 75 MP

[56] References Cited

U.S. PATENT DOCUMENTS

| | | | |
|---|---|---|---|
| 3,538,486 | 11/1970 | Shlesinger, Jr. | 339/74 R |
| 3,731,259 | 5/1973 | Occhipinti | 339/186 M |
| 3,920,302 | 11/1975 | Cutchan | 339/75 MP |
| 3,944,313 | 3/1976 | McKeown et al. | 339/75 MP |
| 4,118,094 | 10/1978 | Key | 339/75 MP |
| 4,221,448 | 9/1980 | Logerot et al. | 339/75 MP |
| 4,379,608 | 4/1983 | Olsson et al. | 339/75 MP |

*Primary Examiner*—John McQuade
*Attorney, Agent, or Firm*—Louis A. Hecht

[57] ABSTRACT

An intermediate connector assembly for establishing electrical connection between a header pin conductor and a remote female connector includes an outer insulating housing having slots defined in a wall, and a cavity adapted to receive a carrier. The cavity includes an interior outer housing surface sloped toward the cavity in a direction of the slotted outer housing wall. The carrier is movably received within the cavity, and carries at least one electrical terminal, the terminal having a male portion extending outwardly from the carrier and the outer housing, and a female portion disposed within the cavity of the outer insulating housing. A wafer adapted to enclose the cavity of the outer housing carries at least one pin conductor for termination to the female terminal portion. The wafer includes drive surfaces for contacting the carrier to force the carrier toward the conductor-receiving outer housing wall to an extent sufficient to establish electrical connection between the female terminal portion and the pin conductor. The female portion, disposed within the cavity, is cammed onto the pin conductor to provide weak or zero insertion force termination.

8 Claims, 4 Drawing Figures

DRAWER CONNECTOR

FIELD OF THE INVENTION

The present invention is directed to an electrical connector, and, more particularly, to a drawer-type electrical connector including a carrier carrying one or more electrical terminals extendable through a wall in an outer insulating housing. The carrier can be moved longitudinally within the outer insulating housing to establish electrical connection to another circuit member disposed outside of the outer insulating housing.

BACKGROUND OF THE INVENTION AND PRIOR ART

One of the problems associated with multi-contact electrical connectors having socket-type female contacts and pin-type male contacts is that termination requires a substantial amount of force. Any force required to make a single termination of a male pin into a female socket-type contact is multiplied by the number of electrical connectors being terminated. Particularly in the field of multi-contact electrical connectors, others have provided various connector configurations to provide a weak or zero insertion force termination between sockets and pins. Examples include the following U.S. Pat. Nos. 4,118,093; 4,274,701; 4,101,192; and an IBM Technical Disclosure bulletin Volume 2 No. 8–10 January–March 1969 page 1333. In accordance with the Biiuerle et al U.S. Pat. No. 4,101,192 and the Bannert et al U.S. Pat. No. 4,274,701, separate insertable releasing tools are used to engage or release the pin and socket electrical connection. In accordance with the Obeissart U.S. Pat. No. 4,118,093, a resilient strip of material is included in the terminal housing and an insulating connector body is axially movable. The resilient strip of material bears against a sloped surface on the interior of the terminal housing so that axial movement of the insulating body progressively tightens the resilient clip to establish electrical contact between the male pins and the female socket-type contacts.

SUMMARY OF THE INVENTION

In brief, the present invention is directed to an intermediate electrical connector assembly for connecting a pin conductor mounted in an insulating wafer to a remote female connector disposed outside of the outer insulating housing. The connector assembly includes an outer insulation housing having one or more slots defined through a wall thereof for receiving at least one electrical conductor carried by the carrier. The outer housing includes a cavity adapted to receive the carrier. The carrier is disposed within the cavity of the outer housing and is longitudinally movable within the cavity. The carried carries at least one electrical terminal, the terminal including a first male portion extending outwardly from a slotted wall of the carrier and of sufficient length to extend outwardly from the wall of the outer housing, and a second female portion disposed within the cavity of the outer insulating housing, and adapted for termination to an electrical pin conductor carried by an insulating wafer. The wafer carries at least one electrical pin conductor extending outwardly therefrom, the pin conductor being adapted to be received within the cavity of the outer insulating housing and adapted for termination to the second, female portion of the terminal to establish electrical connection between the pin conductor and the second, female portion of the terminal. The connector also includes termination and disconnect means for moving the carrier toward or away from the slotted outer housing wall to terminate or release the electrical connection with the remote female connector.

In accordance with one important embodiment of the present invention, a female socket-type portion of the terminal carried by the carrier makes electrical connection with a pin conductor extending from a wafer in a male pin and female socket-type of electrical connection in which weak or zero insertion force is used to establish the electrical connection. This feature is provided by camming the female portion onto the pin conductor after the pin conductor has been positioned without resistance between widened contact areas of the female terminal portion in the cavity. The carrier then can be moved toward the slotted outer housing wall for termination of a second portion of the carrier terminals to another circuit element disposed outside of the outer housing. The camming is achieved by providing one or more sloped or beveled surfaces within the cavity of the outer insulating housing for contact against diverging arm portions of the female terminal portion so that movement of the carrier toward the slotted outer housing wall will terminate the female terminal portion onto the pin conductor within the cavity of the outer housing after the pin conductor and the female portion of the carrier terminal are properly disposed for electrical contact or termination to lock the pin conductor and female portion together within the cavity. After termination, the wafer is forced further into the cavity to cause the male terminal portion to extend further outwardly from the outer housing for electrical connection to the remote female connector. Disconnecting is achieved by withdrawing the wafer away from the cavity of the outer housing thereby pulling the the female portions of the carrier terminals back toward a wider portion of the sloped surface within the cavity. After the female terminal portion is disconnected from the remote female connector the female portion reaches the wider sloped portion of the cavity to release the female terminal portion from the pin conductor.

Accordingly, an object of the present invention is to provide an electrical connector having an interior terminal carrier movable within an outer housing to establish or release electrical contact between the carrier terminal and another circuit element upon movement of the carrier.

Another object of the present invention is to provide a multi-contact electrical connector capable of electrical connection using low or zero insertion force and capable of electrical disconnection using low or zero withdrawal force.

Still another object of the present invention is to provide an electrical connector wherein a carrier carries a plurality of spaced terminals each having a portion extending outwardly from the carrier and extendable outwardly from a slotted housing wall, and each having another portion disposed within the cavity of the outer insulating housing, the second portion adapted for termination to a pin conductor carried by an insulating wafer; and wherein the insulating wafer includes a plurality of pin conductors for termination to the plurality of spaced carrier terminals; and wherein the conductor-receiving outer housing wall includes means for receiving the plurality of spaced male terminal portions for termination of the terminal portions to a remote female connector disposed outside of the outer insulating housing.

Another object of the present invention is to provide an electrical connector having a slidable inner terminal carrier movable within an outer housing cavity to cause electrical connection to a remote female connector disposed outside of the outer housing.

A further object of the present invention is to provide an electrical connector for termination of one circuit element to another circuit element including a pin conductor, female socket-type electrical connection achieved within a housing cavity wherein the female contact comprises a pair of spaced electrical terminal portions adapted to receive the pin conductor in electrical contact therewith.

Another object of the present invention is to provide an electrical connector for termination of one circuit element to another circuit element including a male pin conductor, female socket-type electrical connection achieved within a housing chamber wherein the female contact comprises a pair of spaced arm portions each having a contact area and having a spacing greater than a cross-sectional dimension of the pin conductor and further including camming means for camming at least one of the arm portions to reduce the spacing and terminate the female socket to the pin conductor.

Still another object of the present invention is to provide an electrical connector for termination of one circuit element to another circuit element including a pin conductor, cammable female socket-type electrical connection achieved within a housing chamber wherein the camming is achieved via a sloped surface on an interior of the outer insulating housing cooperating with an interior housing-contacting surface of a female terminal portion to reduce the spacing between spaced-apart female arm portions when a carrier supporting the female portion is moved to force the female terminal portion to contact a different position on the interior surface of the outer insulating housing.

Another object of the present invention is to provide an electrical connector for establishing electrical connection between an electrical terminal carried by a carrier and a remote female connector. The connector includes an outer insulating housing having a conductor-receiving slot formed in a wall of the outer housing. The outer housing also has a cavity adapted to receive the carrier the cavity including an interior surface of the outer housing sloped toward the cavity in a direction of the outer housing wall. The carrier adapted to be movably received within the cavity of the outer insulating housing, and to carry at least one electrical terminal having a first, male portion extending outwardly from a wall of the carrier and of sufficient length to extend outwardly from the slotted wall of the outer housing. The terminal includes a second, female portion disposed within the cavity of the outer insulating housing, the female portion adapted for termination to an electrical pin conductor. A wafer encloses the interior chamber of the outer housing and carries at least one electrical pin conductor extending outwardly therefrom, the wafer conductor adapted to be received within the cavity of the outer insulating housing and adapted for termination to the female portion of the terminal to establish electrical connection between the pin conductor and the female portion of the terminal. The wafer includes a drive member for contacting the carrier to force the carrier toward the conductor-receiving slotted outer housing wall to an extent sufficient to establish electrical connection between the male portion of the terminal and a remote female connector and a female terminal portion disposed within the cavity, the female portion including first and second electrical contact portions disposed on first and second spaced arm portions for contact against the pin conductor within the cavity; the arm portions, extending from contact portions toward the interior sloped surface of the outer housing for contact of the arm portion against the sloped surface to force the arm portion toward the female portion and to force the male portion toward the pin conductor to establish electrical contact between the pin conductor and the female terminal portion.

DETAILED DESCRIPTION OF THE PREFERRED EMBODIMENT

Figure 1:
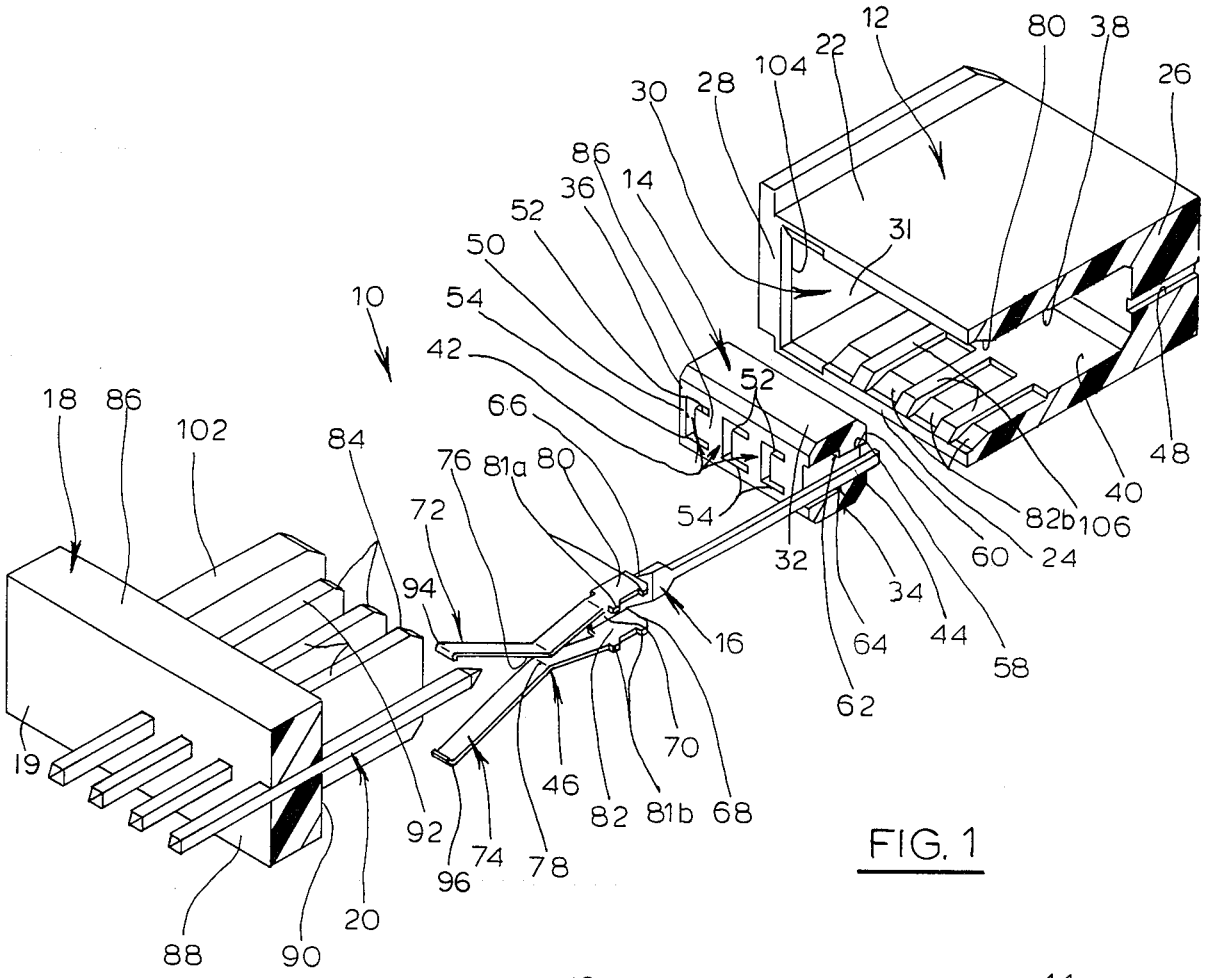
FIG. 1 is an exploded, partially brokenaway, perspective view of an electrical connector constructed in accordance with the principles of the present invention.

Turning now to the drawings, and initially to FIG. 1, the electrical connector of the present invention, generally designated 10, includes an outer insulating housing, generally designated 12; a carrier, generally designated 14, carrying one or more electrical terminals, generally designated 16; and a header 18, comprising a wafer, generally designated 19, carrying one or more pin conductors, generally designated 20.

The outer insulating housing 12 includes upper and lower walls 22 and 24, respectively, a slotted end wall 26 and sidewalls 28 (one of which is not shown) to define a five-sided cavity 30 adapted to receive the carrier 14 and one or more pin conductors 20 carried by wafer 19. The sixth open side comprises a wafer-receiving opening 31. The carrier 14 is cooperatively shaped to the cavity 30 of the outer insulating housing 12. The carrier 14 includes an upper wall 32 and a lower wall 34 and end walls 36 (one of which is not shown). The upper and lower walls 32 and 34 of the carrier 14 contact interior upper and lower walls 38 and 40, respectively in sliding engagement thereagainst, to maintain proper alignment of the carrier 14 within the cavity 30 of the outer insulating housing 12. The interior walls 38 and 40 of the outer housing 12 and the exterior upper and lower walls 32 and 34 of the inner housing 14 are formed of a suitable insulating material having good lubricity for low force sliding movement, such as a polyolefin, e.g. polyethylene or polypropylene or other polymers or copolymers.

Figure 2:
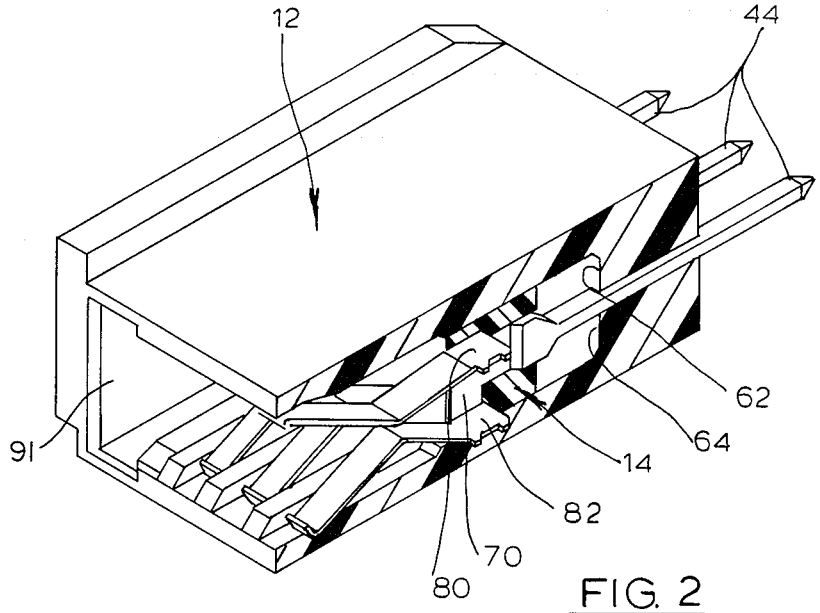
FIG. 2 is a partially broken away, perspective view of an outer housing portion of the electrical connector constructed in accordance with the principles of the present invention.
Figure 4:
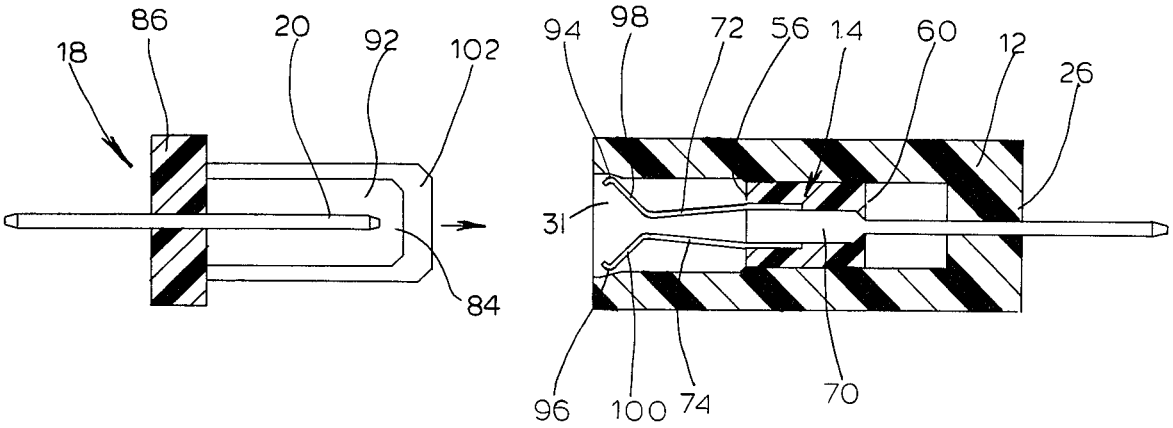
FIG. 4 is a cross-sectional view of the electrical connector of the present invention wherein the wafer conductors are disconnected from the terminals carried by the carrier.
Figure 3:
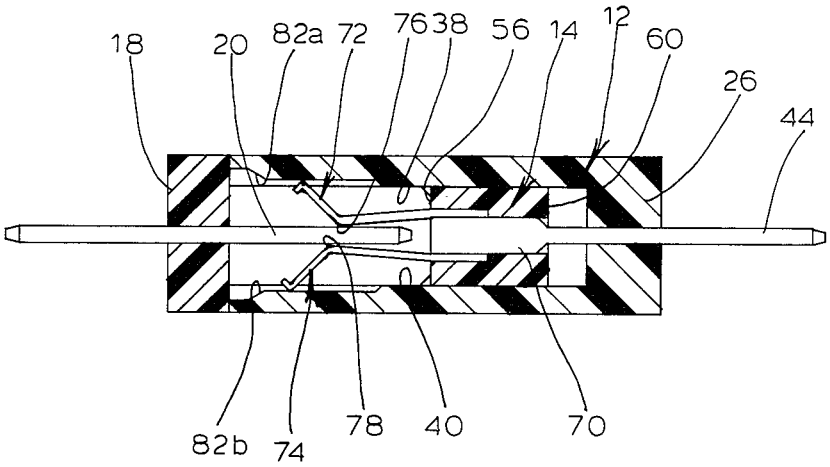
FIG. 3 is a cross-sectional view of the electrical connector of the present invention wherein the terminal carried by the carrier is terminated to an electrical pin conductor carried by a wafer.

The carrier 14 includes a plurality of terminal receiving slots generally designated 42, for fixedly retaining the electrical terminals 16 in the carrier 14 in a transverse, horizontal disposition through the carrier 14. The terminals 16 extend horizontally completely through the carrier 14, as shown in FIGS. 2–4. The electrical terminals 16 carried by the carrier 14 include a first, male terminal portion 44 forming a male pin-type contact and a second, female portion, generally designated 46, forming a female socket-type contact. The male pin contact portions 44 of the terminals 16 extend through slots 48 extending horizontally completely through the slotted end wall 26 of the outer insulating housing 12 for termination to a remote female connector (not shown) disposed outside of the outer insulating housing 12.

The terminal receiving slots designated generally 42 in the carrier 14 are generally U-shaped at a front wall 56 of the carrier 14 with a base 50 of the U vertical and legs 52 and 54 of the U in a horizontal disposition to fixedly receive the female socket type contact portions 46 of the terminals 16 in fixed relationship to the carrier 14. The U-shaped slots 42 extend laterally about half way through the carrier 14 and then continue through the carrier 14 as a smaller, rectangular, horizontal slot 58 extending through to a rearward wall 60 of the carrier 14 for receiving the male pin portions 44 of the terminals 16. The slot juncture, between the U-shaped female socket contact receiving slots and the smaller rectangular male pin-receiving slots, forms upper and lower slot stop walls 62 and 64 for contact against end surfaces 66, 68 of flat plate portions 80, 82 (as will be more fully explained below). This engagement limits the penetration of terminal 16 into the carrier 14 to provide a consistent uniform depth of insertion for terminals 16 within each of the slots 42 of the carrier 14.

The second portion, or female socket type contact portion 46, of the electrical terminal 16 includes a vertical wall portion 70 in electrical contact with the male pin-type contact portions 44 of the terminals 16, received within the vertical base portion 50 of the U-shaped slots 42. The vertical wall portion 70 of the female socket contact portion 46 extends between and is integral with a pair of resilient arm portions 72 and 74. Arm portions 72, 74, comprising a portion of terminal 16, each have contact areas 76 and 78, respectively, for electrical contact against the pin conductors 20 extending from the wafer 19. The resilient arms 72 and 74 are in electrical contact with the vertical wall portion 70 of the female socket type contact portion 46 at their respective horizontal flat plate portions 80 and 82. Flat plate portions 80, 82 include end surfaces 66, 68 respectively, as described above. Upper plate 80 has on its lateral edge, a pair of teeth 81*a*, and lower plate 82 has a similar pair of teeth 81*b*. These teeth, and vertical wall portion 70 are received in terminal receiving slots 42, and form an interference fit with carrier 14. Thus, the female contact socket portion 46 is retained within housing 14. With this arrangement, retaining forces are provided immediately adjacent each resilient conductor 72, 74. The longitudinally-separate teeth 81*a*, 81*b* provide lateral stability, rigidity, and alignment of each arm 72, 74.

In accordance with an important feature of the present invention, the resilient arm portions designated generally 72 and 74 forming the female socket type portion 46 of the terminal 16 are capable of flexing between pin releasing and pin engaging positions by being able to widen or lessen the spacing between the contact areas 76 and 78 of the arm portions 72 and 74 to terminate or release the contact areas 76 and 78 against the pin conductors 20 carried by the wafer 19. The resilient arm portions 72 and 74 are initially formed to provide a pin releasing spacing between the contact areas 76 and 78 having a greater dimension than the height or cross sectional dimension of the pin conductors 20 carried by the wafer 19. In this manner, the pin conductors 20 can be inserted between the electrical contact areas 76 and 78 with a weak or zero insertion force until the arms 72 and 74 are flexed toward each other to engage the contact areas 76 and 78 against the electrical pin conductors 20 of the wafer 19, as will be described in more detail hereinafter.

In accordance with another important feature of the present invention, (FIGS. 3 and 4) the interior upper and lower walls 38 and 40, respectively, of the outer insulating housing 12 include slanted wall portions 82*a* and 82*b*, respectively, for contact against the camming surfaces 94, 96 formed adjacent the free ends of resilient arm portions 72 and 74. As the carrier 14 is forced toward the slotted end wall 26 of the outer insulating housing 12, the arms 72 and 74 flex toward each other to engage the electrical contact areas 76 and 78 against the pin conductors 20 carried by the wafer 19. The frictional engagement between arms 72, 74 and pin 20 is provided such that translational forces applied to pin 20 will be transferred to arms 72, 74 and, in turn, to inner housing 14. Thus, as wafer 19 is retracted during disconnection, carrier 14 is also displaced, with arms 72, 74 being allowed to move away from each other so as to release pin 20 with a zero or near-zero disconnector force. As noted above, the upper and lower walls of housing 14 are formed of an insulating material having good lubricity, such that the frictional forces generated by camming surfaces of arm portions 72, 74 during connection and disconnection, are negligible compared to the frictional engagement between pin 20 and contact areas 76, 78.

The carrier 14 is forced manually from an unterminated position adjacent the wafer receiving opening of housing 12, toward a terminated position the slotted end wall 26 of the outer insulating housing 12 by one or a plurality of drive surfaces 84 extending from the wafer 19. The wafer 19 generally includes a rectangular block of insulating material 86 carrying a plurality of the pin conductors 20 extending laterally through the insulating block 86, horizontally, from an outer surface 88 through an inner surface 90 of the insulating block 86. A plurality of elongated inner housing drive members 92 extend from the inner surface 90 of the insulating block 86 and form the vertical drive surfaces 84 forming the ends of the inner housing drive members 92. As the pin conductors 20 and drive members 92 of the wafer 19 are inserted within the cavity 30 of the outer insulating housing 12, the drive surfaces 84 on the carrier drive members 92 contact the front wall 56 of the carrier 14 to force the carrier 14 toward the slotted end wall 26 in the outer insulating housing 12. As the carrier 14 is forced toward the slotted end wall 26 of the outer insulating housing 12, an uppermost camming surface 94 of resilient arm portion 72 and a lowermost camming surface 96 of resilient arm portion 74 are forced toward each other by movement against converging slanted interior wall portions 82*a*, 82*b* of the outer insulating housing 12, converging in a direction toward pin conductors 20, to force the electrical contact areas 76 and 78 against the pin conductors 20 carried by the wafer 19 to terminate, as shown in the terminated position of FIG. 3.

The resilient arm portions 72 and 74 are formed in a V-shape in opposed diverging relationship, with the base of each V on each arm portion 72 and 74 facing the other so that arm 72 extends toward the upper interior outer insulating housing wall 38 and arm 74 extends toward the lower interior outer insulating housing wall 40, for contact against the slanted interior wall portions 82*a* and 82*b* at the uppermost and lowermost female conductor surfaces 94 and 96, respectively, to provide a camming action for arm portions 72 and 74 to achieve termination of the female socket-type portion 46 with pin-conductors 20, within the cavity 30 of the outer insulating housing 12.

The interior upper and lower walls 38 and 40 of the outer insulating housing 12 include integral separating walls 106 disposed between adjacent female socket portions 46 of the electrical terminals 16 to maintain vertical alignment of the socket terminal portions 46 and separation between adjacent female socket portions 46 within the cavity 30 of the outer insulating housing 12. The wafer 19 further includes an alignment boss 102 cooperatively shaped to fit within an alignment slot 104 in the outer insulating housing 12 to maintain alignment of the pin conductors 20, carried by the wafer 19, with the female socket portions 46 of the terminals 16 carried by the carrier 14 for proper weak or zero insertion force termination. When the pin conductors 20 are fully inserted into the cavity 30, the cavity 30 is completely enclosed, as shown in FIG. 3.

Many modifications can be made to the invention described with reference to the preferred embodiment. For example, the wafer 19 could be provided with the female contact portion 46 extending into the cavity 30, and the carrier 14 could be a wafer having male pin type contacts extending through the front and rear walls 56 and 60. The sloped or beveled surfaces 82*a* and 82*b*, in this embodiment, could be re-positioned within the cavity 30 to achieve termination after terminal 16 is properly positioned within the cavity 30.

I claim:

1. An intermediate connector assembly providing selective electrical interconnection between a header having a pin conductor mounted in a dielectric wafer and a remote female connector having at least one female terminal, said connector assembly comprising:

a dielectric housing having a header receiving cavity, with an opening communicating with said cavity and an interior camming surface facing said cavity, a dielectric carrier mounted within said header receiving cavity for movement between an unterminated position and a terminated position in response to said header being moved from a withdrawn position to a fully inserted position within said cavity, a rigid unitary terminal mounted on said carrier for movement therewith, said terminal including a female portion mateable with said pin conductor and a male portion mounted for movement relative to said housing for selective mating and unmating with said female terminal, said female portion having spaced-apart resilient contact portions for receiving said pin conductor therebetween and cam means engageable with said housing camming surface as said carrier is moved between said unterminated and said terminated positions, said contact portions being movable relative to each other between pin engaging and pin releasing positions in response to the cam means engaging said camming surface.

2. The connector assembly of claim 1 wherein said terminal and said carrier comprise a rigid, unitary assembly such that upon withdrawal of said pin conductor from said cavity, a withdrawal force is applied to said contact portions by frictional engagement with said pin conductor and is transmitted to said terminal camming means and said male portion, said male portion extending through a slotted end wall of said housing and being moved between first and second positions as said carrier is moved between said unterminated and said terminated positons.

3. The connector assembly of claim 2 wherein said terminal female portion frictionally engages said pin conductor when said header is in said fully inserted position and said carrier is in said terminated position, and maintains said frictional engagement as said header is moved toward said withdrawn position to thereby move said carrier toward said unterminated position.

4. The connector assembly of claim 3 wherein said housing camming surface is located immediately adjacent said housing opening.

5. The connector assembly of claim 4 wherein said housing camming surface comprises an opposed pair of inner housing surfaces diverging toward said housing opening, said unterminated position being located immediately adjacent said housing opening, and said terminated position being located remote from said housing opening.

6. The connector assembly of claim 2 further including alignment means for aligning the pin conductor with the female portion.

7. The connector assembly of claim 6 wherein said alignment means comprises a guide boss extending outwardly from the header wafer, and wherein the housing further includes means defining a slot cooperably shaped for receiving the guide boss to maintain alignment of said pin conductor with said female portion.

8. The connector assembly of claim 5 wherein said intermediate connector assembly further includes a pair of opposed converging arm portions joined at a first end to said male portion, and joined at a second end through said contact portions to a pair of opposed diverging arm portions having free ends carrying camming surfaces comprising said terminal cam means, said camming surfaces engageable with said housing camming surface to selectively reduce the spacing between said contact portions, thereby terminating said pin conductor as said carrier is moved toward said terminated position, and to selectively increase the spacing between said contact portions thereby releasing pin conductor, as said carrier is moved toward said unterminated position.

* * * * *